US009966054B1

(12) United States Patent
Korpela

(10) Patent No.: US 9,966,054 B1
(45) Date of Patent: May 8, 2018

(54) PICKUP FOR STRINGED INSTRUMENTS

(71) Applicant: Prodeng Product Engineering Oy, Turku (FI)

(72) Inventor: Kimmo Korpela, Nauvo (FI)

(73) Assignee: Prodeng Product Engineering Oy, Turku (FI)

( * ) Notice: Subject to any disclaimer, the term of this patent is extended or adjusted under 35 U.S.C. 154(b) by 0 days. days.

(21) Appl. No.: 15/462,030

(22) Filed: Mar. 17, 2017

(51) Int. Cl.
*G10H 3/14* (2006.01)
*G10H 3/18* (2006.01)

(52) U.S. Cl.
CPC ..... *G10H 3/181* (2013.01); *G10H 3/143* (2013.01); *G10H 3/182* (2013.01); *G10H 2220/565* (2013.01)

(58) Field of Classification Search
CPC ..... G10H 3/181; G10H 3/143; G10H 3/182; G10H 2220/565
USPC ..... 84/726–728, 730, 731
See application file for complete search history.

(56) References Cited

U.S. PATENT DOCUMENTS 4,501,186 A * 2/1985 Ikuma ..... G10H 3/182 84/726
2014/0096668 A1* 4/2014 McMillen ..... G10H 3/143 84/731

* cited by examiner

*Primary Examiner* — Jeffrey Donels
(74) *Attorney, Agent, or Firm* — Ziegler IP Law Group, LLC

(57) ABSTRACT

A pickup for a stringed musical instrument, including at least one magnet and at least one pressure sensitive element arranged in contact with the at least one magnet.

9 Claims, 4 Drawing Sheets

PICKUP FOR STRINGED INSTRUMENTS

TECHNICAL FIELD

The present disclosure relates generally to transducers, and more specifically, to pickup assemblies for stringed musical instruments.

BACKGROUND

A pickup is a transducer that captures or senses mechanical vibrations produced by musical instruments, particularly stringed instruments, and converts them to an electrical signal. The electrical signal is in turn amplified using an instrument amplifier to produce musical sounds through a speaker. Pickup assemblies enable quiet or relatively quiet instruments such as the electric guitar, electric bass guitar, Chapman Stick or electric violin to be audible when played with other louder musical instruments or to larger audiences. Existing pickup assemblies are primarily of three types, namely body pickups, accelerometer pickups and string pickups.

For example, with reference to an electric guitar, body pickups may be directly attached to an inside part of a top of the electric guitar, and behind a bridge of the electric guitar. The body pickups are typically made of a piezoelectric sensor material such as piezoelectric crystal or film or from electret film material. The accelerometer pickups are typically mounted to measure the movement of a top or body of an instrument, which directly correlates to the sound of the instrument. The string pickups typically detect vibrations from the strings. Most electric guitars and electric bass guitars use magnetic pickups.

Magnetic pickups convert vibrations of guitar strings through electromagnetic induction into electrical signals, which may be amplified or modified so as to provide desired volume and/or sound effects. Traditional magnetic pickups typically detect vibrations or movements of strings in an electromagnetic field to induce electrical current in a coil. The traditional single coil magnetic pickups are prone to capture noise from electromagnetic fields due to mains electricity, wiring, power transformers, fluorescent light ballasts etc. in the vicinity and produce electrical interference. This in turn creates noise disturbances in the sound when amplified.

Therefore, in light of the foregoing discussion, there exists a need to overcome the aforementioned drawbacks in existing pickups due to electrical interference that causes undesirable noise.

SUMMARY

The present disclosure provides a pickup for a stringed musical instrument, comprising at least one magnet and at least one pressure sensitive element arranged in contact with the at least one magnet.

The present disclosure also provides a method for transducing movement of a string of a stringed musical instrument into an electric signal, in which method the movement of the string induces movement of a magnet and the movement of the magnet is sensed with a pressure sensitive element, thereby transducing it into the electric signal.

Embodiments of the present disclosure substantially eliminate or at least partially address the aforementioned problems in the prior art, and enables elimination of electrical interference.

Additional aspects, advantages, features and objects of the present disclosure are made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
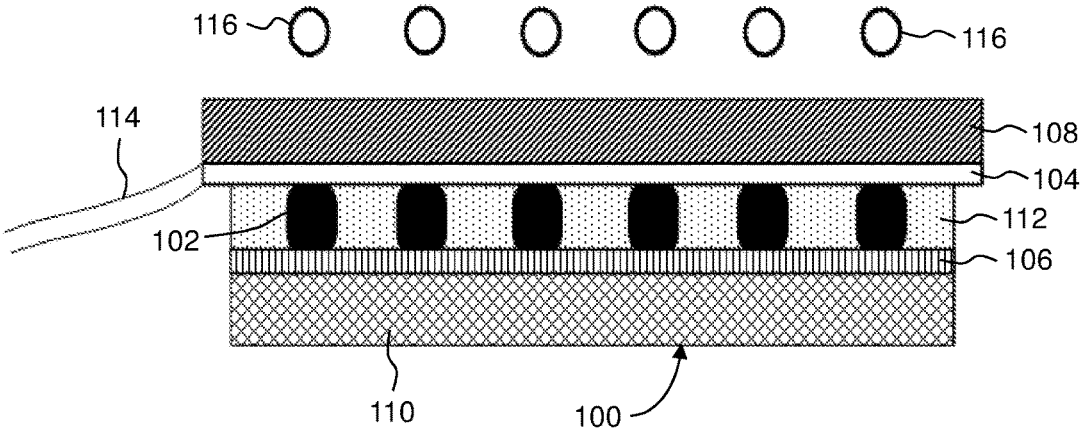
FIG. 1 is a sectional view of a pickup for a stringed musical instrument in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

The present disclosure provides a pickup for a stringed musical instrument, comprising at least one magnet and at least one pressure sensitive element arranged in contact with the at least one magnet.

The pickup eliminates incidental noise and electrical interference caused due to electromagnetic fields and provides a realistic sound while playing the stringed musical instrument. This pickup may be suitable for guitars, basses and other stringed musical instruments such as a harpsichord, a piano and a violin etc. The at least one magnet and the at least one pressure sensitive element may be mechanically coupled with each other. The at least one magnet transduces vibration of strings into mechanical movements.

The at least one pressure sensitive element transduces the mechanical movements of the at least one magnet into an electrical signal. The pickup may be arranged in the body or in any other part of the stringed musical instrument based on the structure of the stringed musical instrument.

According to an embodiment, the pickup comprises an elastic element arranged in contact with the at least one magnet, on an opposing side with respect to the at least one pressure sensitive element. The elastic element prevents excess movement of the at least one magnet in a vertical direction and prevents the at least one magnet from dropping off. In order to prevent excess movement, the at least one magnet may be attached to at least one pressure sensitive element using binding means such as glue or any other suitable binding material. In the present description, the term "elastic" is to be understood in its common sense, i.e. for example material made of rubber or an elastomer.

According to another embodiment, the pickup comprises a rigid cover arranged in contact with the at least one pressure sensitive element, on an opposing side with respect to the at least one magnet. The rigid cover may protect the pickup from physical damage. In an embodiment, the pressure sensitive element is arranged between the rigid cover and the at least one magnet.

According to another embodiment, the pickup comprises a casing. The rigid cover discussed above may be a part of the casing, which casing is attached to the stringed musical instrument. The rigid cover may be made up of metal, wood, plastic or fibreglass or any combination of these, and is optionally bound to the casing with an epoxy or any suitable resin.

The casing may thus be arranged to be attached to the stringed musical instrument (e.g. a guitar, a harpsichord, a piano, a violin etc.). The casing may be used to keep the at least one magnet and the at least one pressure sensitive element in contact with each other. The casing may be adjustable to adjust the distance of the pickup from strings of the stringed musical instrument.

According to yet another embodiment, the casing comprises an elastic material as a filling. The elastic material may surround the at least one magnet to prevent the at least one magnet from moving around horizontally and to prevent physical damage to the magnet in an event that the stringed musical instrument falls down.

According to yet another embodiment, the pickup comprises, for each string of the musical instrument, one magnet and one pressure sensitive element arranged in contact with the magnet. In an embodiment, the magnet is attached to the pressure sensitive element using glue for preventing excess movement of the magnet. In an embodiment, for each string of the musical instrument, more than one magnet is arranged in contact with the one pressure sensitive element. For example, there may be two, three, four or five magnets for each pressure sensitive element.

According to yet another embodiment, the pickup comprises, for each string of the musical instrument, at least two magnets aligned with the string. In an embodiment, the at least two magnets are aligned vertically with the string. In another embodiment, the at least two magnets are aligned horizontally with the string. In the horizontal alignment, the string may be aligned in-between the two magnets.

According to yet another embodiment, the strength of each magnet is selected according to a diameter and material of the string. In an embodiment, the at least one magnet and the string are pulled toward each other to create string vibrations. The string vibrations are converted into a magnetic force, which is then sensed by the at least one pressure sensitive element and converted into an electric signal. In an embodiment, the at least one magnet is typically cylindrical in shape. In another embodiment, the shape of the at least one magnet is a cube, oblique cylinder or a cuboid.

In an embodiment, the at least one magnet is a permanent magnet made of a material having high remanence. Examples of such materials are $Nd_2Fe_{14}B$, commonly referred as neodymium magnet; $SmCo_5$, commonly referred as samarium-cobalt magnet; aluminium-nickel-cobalt alloys. The size of the at least one magnet may typically range from 1 millimeter to 3 millimeters. The mass of the at least one magnet may range from 5 milligrams to 200 milligrams with a density of $7\times10^3$ (kilogram per cubic meter). In an embodiment, the sound characteristics (e.g. transfer function of the magnet vibrations into the electrical signal) may be subjected to change based on the shape, mass and magnetic properties of the at least one magnet. The size and the shape of the at least one magnet may be selected based on the mass and magnetic properties of each of the strings. In an embodiment, a polarity or a direction of the magnetic axis of the at least one magnet is selected to adjust the sound characteristics.

According to yet another embodiment, the pickup comprises electrical wires for electrical connection of the at least one pressure sensitive element with an amplifier. According to yet another embodiment, the pressure sensitive element is selected from a piezoelectric element, a polyvinylidene fluoride (PVDF) film and an electret film. In an embodiment, the pressure sensitive element is selected from a piezoelectric sensor, a Lead zirconate titanate (PZT) ceramic, crystal materials and a film type sensor. The film type sensor may be an electromechanical film (EMFi) sensor or a polypropylene film sensor. In another embodiment, the pressure sensitive element is selected from a piezo-resistive sensor, a piezo-capacitive sensor and a piezo-inductive sensor. The pressure sensitive element may convert the movements or vibrations of the at least one magnet into the electrical signal. The electric signal produced by the at least one pressure sensitive element may be preferably amplified with a preamplifier. In an embodiment, the preamplifier is located in the vicinity of the pickup in order to reduce the noise.

The present disclosure also provides a method for transducing movement of a string of a stringed musical instrument into an electric signal, in which method the movement of the string induces movement of a magnet and the movement of the magnet is sensed with a pressure sensitive element, thereby transducing it into the electric signal. The advantages of the present method are identical to those disclosed above in connection with the pickup and the embodiments listed above in connection with the pickup apply mutatis mutandis to the method.

Embodiments of the present disclosure may provide an electrical interference free, original sound (e.g. free from noise) and improve performance of a performer while playing the stringed musical instrument. The embodiments of the present disclosure may provide realistic sound characteristics of the stringed musical instrument due to magnetic properties of the at least one magnet. Further, embodiments of the present disclosure may reduce noise in the sound characteristics of the stringed musical instrument by arranging a preamplifier in the vicinity of the pickup.

DETAILED DESCRIPTION OF THE DRAWINGS

FIG. 1 is a cross sectional view of a pickup 100 for a stringed musical instrument in accordance with an embodiment of the present disclosure. The pickup 100 comprises magnets 102 and one pressure sensitive element 104. The pickup 100 further comprises an elastic element 106, a rigid cover 108, a casing 110, elastic material 112 surrounding the magnets 102, and electrical wires 114. The stringed musical instrument comprises strings 116. The functions of these parts are as have been described above.

Figure 2:
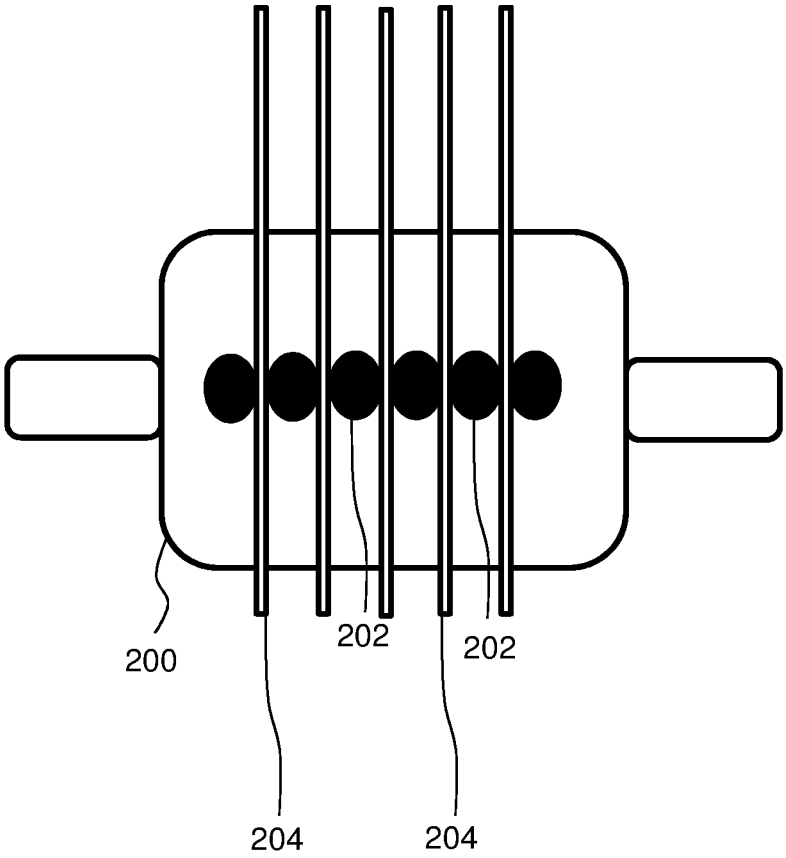
FIG. 2 is a sectional view of a pickup for a stringed musical instrument in accordance with an embodiment of the present disclosure.

FIG. 2 is a sectional top view of a pickup 200 for a stringed musical instrument in accordance with an embodiment of the present disclosure. The pickup 200 comprises magnets 202 and the stringed musical instrument comprises strings 204. The magnets 202 are horizontally positioned inside the pickup 200 and the strings 204 are aligned in between the magnets 202.

Figure 3:
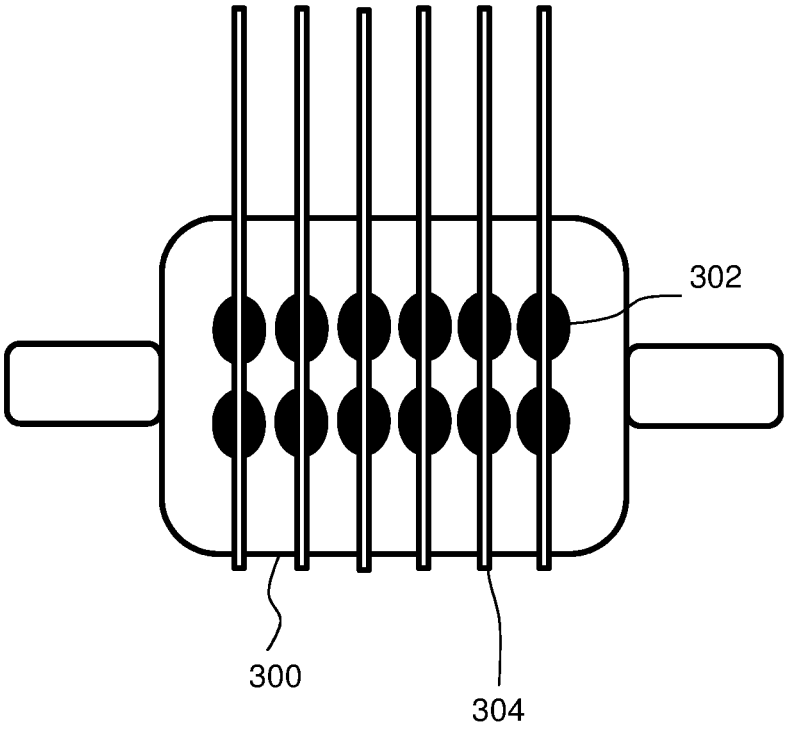
FIG. 3 is a sectional view of a pickup in accordance with an embodiment of the present disclosure.

FIG. 3 is a sectional top view of a pickup 300 in accordance with an embodiment of the present disclosure. The pickup 300 comprises magnets 302 that are vertically positioned with respect to strings 304 of a stringed musical instrument.

Figure 4:
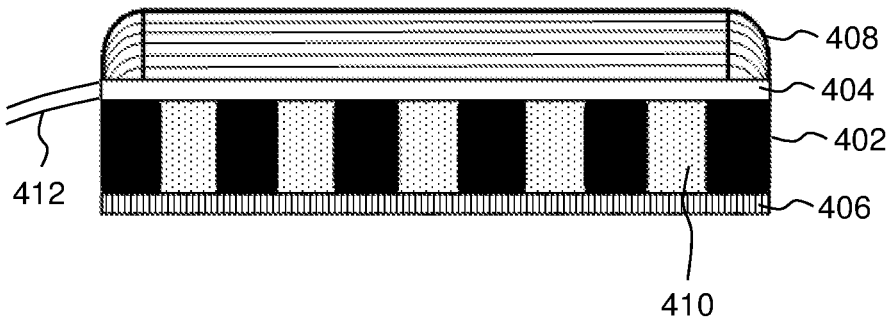
FIG. 4 is a schematic illustration of a pickup without a casing in accordance with an embodiment of the present disclosure.

FIG. 4 is a schematic illustration of a pickup without a casing in accordance with an embodiment of the present disclosure. The pickup comprises magnets 402, a pressure sensitive element 404, an elastic element 406, a cover 408 and electrical wires 412. The pressure sensitive element 404 is arranged in contact with magnets 402.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A pickup for a stringed musical instrument, comprising at least one magnet and at least one pressure sensitive element arranged in contact with the at least one magnet, wherein for each string of the musical instrument, one magnet and one pressure sensitive element is arranged in contact with the magnet, and a strength of the magnet is selected according to a diameter and a material of the string.

2. A pickup according to claim 1, further comprising an elastic element arranged in contact with the at least one magnet, on an opposing side with respect to the at least one pressure sensitive element.

3. A pickup according to claim 1, further comprising a rigid cover arranged in contact with the at least one pressure sensitive element, on an opposing side with respect to the at least one magnet.

4. A pickup according to claim 1, further comprising a casing.

5. A pickup according to claim 4, wherein the casing comprises an elastic material as a filling.

6. A pickup according to claim 1, further comprising, for each string of the musical instrument, at least two magnets aligned with the string.

7. A pickup according to claim 1, further comprising electrical wires for electrical connection of the at least one pressure sensitive element with an amplifier.

8. A pickup according to claim 1, wherein the pressure sensitive element is selected from a piezoelectric element, a polyvinylidene fluoride film and an electret film.

9. A method for transducing movement of a string of a stringed musical instrument into an electric signal using a pickup comprising at least one magnet and at least one pressure sensitive element arranged in contact with the at least one magnet, wherein for each string of the musical instrument, one magnet and one pressure sensitive element is arranged in contact with the magnet, and a strength of the magnet is selected according to a diameter and a material of the string, the method comprising:

inducing a movement of the magnet by movement of the string;

sensing the movement of the magnet with the pressure sensitive element; and transducing the movement of the magnet into the electric signal.

* * * * *